US007766363B2

(12) United States Patent
Farcot et al.

(10) Patent No.: US 7,766,363 B2
(45) Date of Patent: Aug. 3, 2010

(54) ASSEMBLY FOR RETAINING A BOOT ON A GLIDING BOARD

(75) Inventors: David Farcot, Annecy (FR); Jean-François Gonthier, Viuz la Chiesaz (FR); Henri Rancon, Cran Gevrier (FR)

(73) Assignee: Salomon S.A.S., Metz-Tessy (FR)

( * ) Notice: Subject to any disclaimer, the term of this patent is extended or adjusted under 35 U.S.C. 154(b) by 698 days.

(21) Appl. No.: 10/083,492

(22) Filed: Feb. 27, 2002

(65) Prior Publication Data

US 2002/0117833 A1 Aug. 29, 2002

Related U.S. Application Data

(63) Continuation of application No. 09/990,308, filed on Nov. 23, 2001, now abandoned.

(30) Foreign Application Priority Data

Nov. 24, 2000 (FR) ..... 00 15372

(51) Int. Cl.
*A63C 9/02* (2006.01)

(52) U.S. Cl. ..... 280/618; 280/14.21; 280/620; 280/633

(58) Field of Classification Search ..... 280/607, 280/618, 14.21, 14.24, 617, 620, 633; 441/68, 441/70

See application file for complete search history.

(56) References Cited

U.S. PATENT DOCUMENTS 1,858,120 A * 5/1932 Stevens ..... 280/607
3,917,300 A 11/1975 Salomon ..... 280/11.35 R
5,042,829 A * 8/1991 Sedlmair ..... 280/633
5,143,396 A * 9/1992 Shaanan et al. ..... 280/607
5,188,386 A * 2/1993 Schweizer ..... 280/607
5,221,105 A * 6/1993 Mayr et al. ..... 280/633
5,261,689 A * 11/1993 Carpenter et al. ..... 280/618
5,356,170 A * 10/1994 Carpenter et al. ..... 280/618
5,380,031 A * 1/1995 Vitali et al. ..... 280/611
5,413,371 A * 5/1995 Trimble ..... 280/602
5,553,883 A 9/1996 Erb ..... 280/607
5,577,755 A * 11/1996 Metzger et al. ..... 280/607
5,765,853 A * 6/1998 Erb ..... 280/607
5,791,678 A * 8/1998 Perlman ..... 280/618
5,803,481 A * 9/1998 Eaton et al. ..... 280/633
5,890,729 A * 4/1999 Bayer et al. ..... 280/618
5,909,893 A * 6/1999 Keller et al. ..... 280/607
5,941,552 A * 8/1999 Beran ..... 280/607
6,065,768 A * 5/2000 Lee ..... 280/607
6,206,402 B1 * 3/2001 Tanaka ..... 280/607
6,386,574 B1 * 5/2002 Tanaka ..... 280/607

FOREIGN PATENT DOCUMENTS

WO WO00/23156 4/2000

* cited by examiner

*Primary Examiner*—Jeffrey J Restifo
*Assistant Examiner*—Katy Meyer
(74) *Attorney, Agent, or Firm*—Greenblum & Bernstein, P.L.C.

(57) ABSTRACT

An assembly for retaining a boot on a sports apparatus. The assembly includes a base, a disk having at least two elongated holes parallel to one another, and at least two screws each extending through an elongated hole. The assembly further includes a plate that is parallel to the disk, the plate sliding along the length of the elongated holes, at least two holes extending through the plate in its thickness, each screw extending through a hole of the plate, and retaining elements retaining the screws on the plate.

36 Claims, 5 Drawing Sheets

ASSEMBLY FOR RETAINING A BOOT ON A GLIDING BOARD

CROSS-REFERENCE TO RELATED APPLICATIONS

This application is a continuation of application Ser. No. 09/990,308, filed on Nov. 23, 2001, now abandoned, the disclosure of which is hereby incorporated by reference thereto in its entirety, and the priority of which is hereby claimed under 35 U.S.C. §120.

This application is based upon French Patent Application No. 00 15372, filed Nov. 24, 2000, the disclosure of which is hereby incorporated by reference thereto in its entirety, and the priority of which is hereby claimed under 35 U.S.C. §119.

BACKGROUND OF THE INVENTION

1. Field of the Invention

The present invention relates to an assembly for retaining a boot on a sports apparatus, such as a gliding board.

2. Description of Background and Relevant Information

Assemblies of the aforementioned type are used in fields such as skiing, snowboarding, water skiing, snowshoeing, skateboarding, and the like.

Generally speaking, a retaining assembly includes a base provided to receive the foot of a user or the sole of a boot. A disk serves to retain the base on the apparatus, the disk itself being retained on the apparatus by screws that extend through elongated holes of the disk that extend into its thickness.

To mount the retaining assembly on the apparatus, or to adjust the position of the assembly on the apparatus, the user generally must screw the screws successively into bushings, which are themselves anchored in the apparatus.

The positioning of the screws in the bushings, through the elongated holes of the disk, takes times and requires a certain amount of skill. For each of the screws, it is necessary to successively locate the bushing, position the screws, and then turn the screw until it is seated.

The mounting and adjusting operations are relatively time-consuming and tedious.

SUMMARY OF THE INVENTION

An object of the invention in particular is to facilitate the positioning of an assembly for retaining a boot on a gliding board.

To this end, the invention proposes an assembly for retaining a boot on a sports apparatus, the assembly including a base provided to receive the sole of the boot, a disk provided to retain the base on the apparatus, the disk having at least two elongated holes parallel, or substantially parallel to one another, which extend through the disk in its thickness, and at least two screws each extending through an elongated hole.

The retaining assembly according to the invention further includes a plate that is parallel, or substantially parallel, to the disk, the plate sliding along the length of the elongated holes, at least two holes extending through the plate in its thickness, each screw extending through a hole of the plate, and retaining means retaining the screws on the plate.

Thus, when the user displaces a screw along an elongated hole, in order to position the screw in front of a bushing of the board, all of the screws are displaced simultaneously and are each positioned in front of a bushing of the board.

The user positions all of the screws in a single manipulation. As a result, the mounting and adjusting operations are less time-consuming and simpler. The positioning of the assembly for retaining a boot on the board is easier.

BRIEF DESCRIPTION OF DRAWINGS

Other characteristics and advantages of the invention will be better understood from the description that follows, with reference to the annexed drawings showing, by way of non-limiting examples, how the invention can be embodied, and in which.

DETAILED DESCRIPTION OF THE INVENTION

The first example, or embodiment, of the invention is described hereinafter with reference to FIGS. 1-4.

Figure 1:
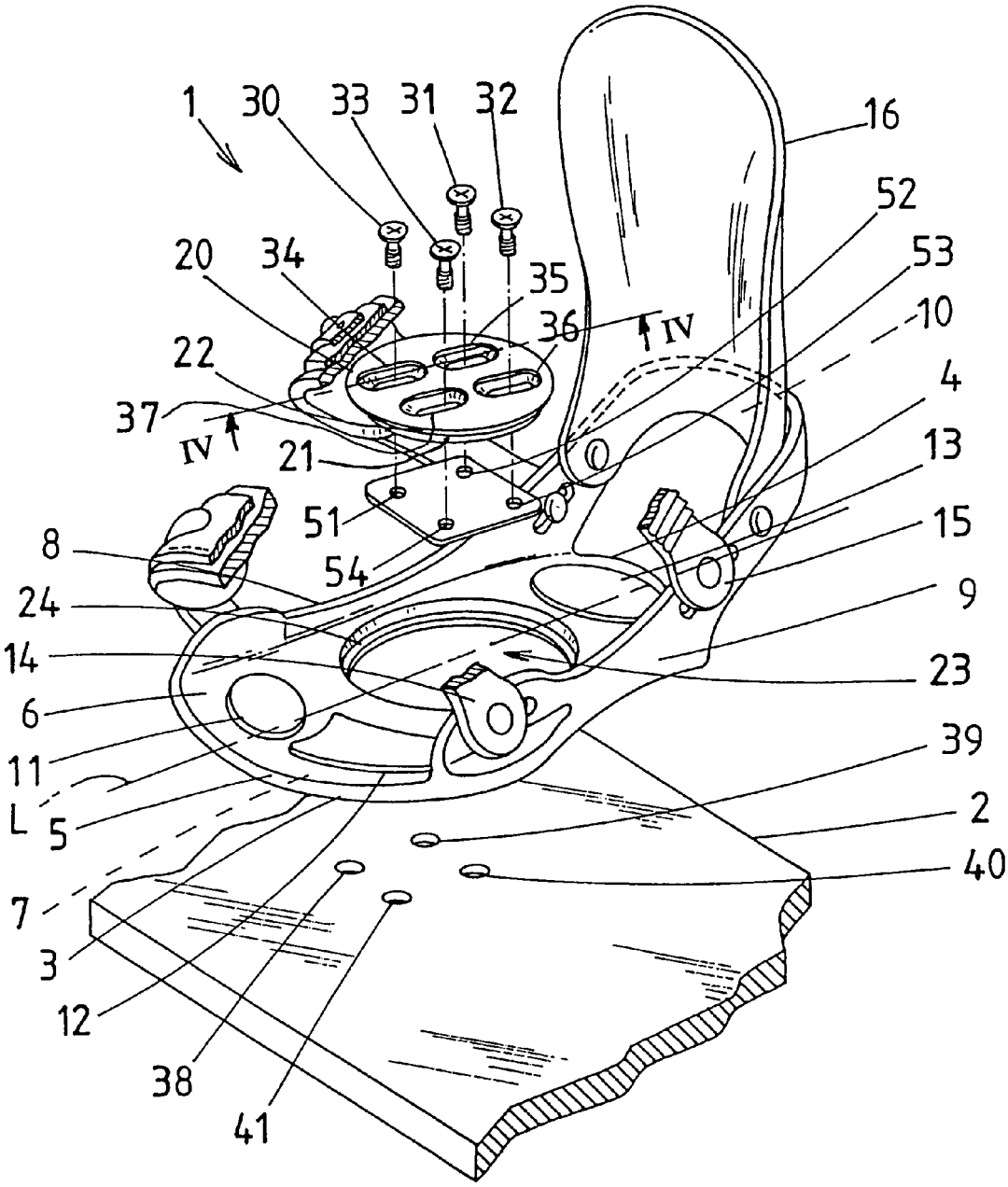
FIG. 1 is a perspective exploded view of a retaining assembly according to a first embodiment of the invention.

As seen in FIG. 1, a retaining assembly 1 makes it possible to retain a boot, not shown, on a sports apparatus 2. The latter is shown in the form of a board. The board can be a snowboard, for example.

In a known fashion, the retaining assembly 1 includes a base 3 that extends along a longitudinal direction L, between a rear end 4 and a front end 5. An upper surface 6 of the base 3 is provided to receive the sole of the boot. A lower surface 7 of the base 3 is provided to be above the board 2. The upper surface 6 is transversely demarcated, at least in part, by lateral flanges 8, 9. An arch 10 connects the flanges 8, 9 to one another toward the rear end 4.

The base 3, flanges 8, 9, and arch 10 are shown in the form of a unitary piece made, for example, of a plastic material. However, one could provide for the flanges 8, 9 and the arch 10 to be attached on the base by any means, such as adhesive (s), screws, and/or the like.

Although not necessary according to the invention, pads 11, 12, 13 are arranged so as to project with respect to the upper surface 6 of the base 3. These pads are made preferably of a flexible plastic material, such as silicone, polyurethane, or the like, for absorbing impacts.

According to the embodiment shown, the boot is retained on the base 3 by means shown in the form of straps 14, 15. These straps can be opened, closed, tightened or loosened by the user, using any means known to a person with ordinary skill in the art.

The means for retaining the boot could be different. For example, one can provide one or several latches fixed to the base and an anchoring member fixed to the boot, the latter being removably housed in the latch.

A rear support element 16 is arranged in the area of the arch 10 so that the user can press toward the rear of the assembly 1 with the lower leg. The support element 16 is journalled along a substantially transverse axis, so that it can be folded forwardly for storage.

In the preferred embodiment shown, the base 3 of the assembly 1 further includes a disk 20 to retain the assembly 1 on the board 2.

To this end, the disk 20 is obtained in the form of a lower cylinder 21 overlaid by a shoulder 22. The disk is nested, from the upper surface 6, in a circular opening 23 of the base 3. The outer shape of the disk 20 and the shape of the circular opening 23 are complementary, the opening 23 being demarcated in its lower portion by a shoulder 24.

The shoulders 22, 24 preferably have a parallelepipedic cross section, but they could have another shape such as that of a truncated cone, a rounded shape, or the like.

Preferably, the shoulders 22, 24, respectively, have peripheral toothings that are nested in one another in order to obtain a rotational obstacle connection of the base 3 with respect to the disk 20. Alternatively, a frictional connection could be provided, in which toothings are omitted.

The disk 20 itself is detachably affixed to the board 2 by a means shown in the form of four screws 30, 31, 32, 33 that extend through four elongated holes 34, 35, 36, 37, respectively, of the disk 20 in its thickness.

The four screws are screwed into the board 2, for example, into threaded bushes, or bushings, 38, 39, 40, 41, which are themselves anchored in the board.

The four bushes are each located at the top of a square, having sides 40 millimeters (mm) long, for example, or approximately 40 mm long.

So that the disk 20 can be displaced translationally with respect to the board 2, the four elongated holes 34, 35, 36, 37 are parallel to one another, aligned in pairs, and across from one another in pairs.

All of the elongated holes preferably have the same length, which can be between about 20 mm and 30 mm.

A different number of screws and elongated holes could be provided. For example, three screws could each be arranged at the vertex of an equilateral triangle. In this case, the disk would have three elongated holes and the bushes would be arranged in triangle.

According to the invention, a plate 50 is arranged so as to be parallel to the disk 20, such that it can slide along the length of the elongated holes.

Figure 3:
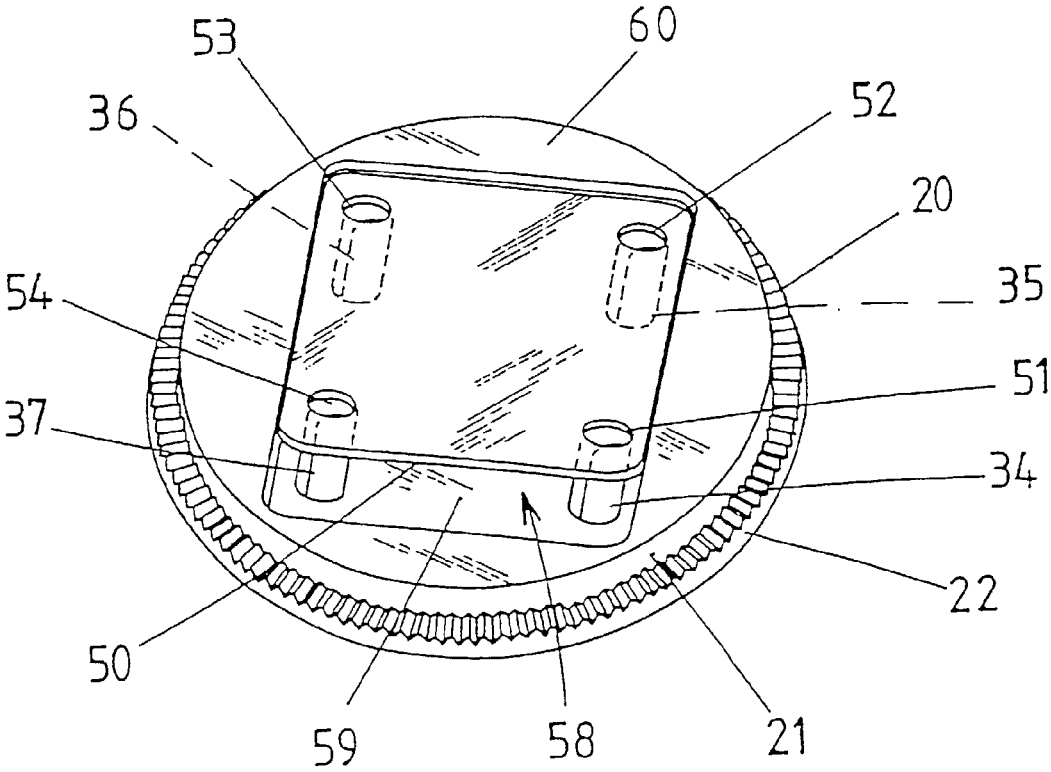
FIG. 3 is a perspective bottom view of the disk and of the plate of the retaining assembly according to the first embodiment.

As shown in FIG. 3, the plate 50 is housed in a cavity 58 provided in the lower portion of the disk 20. The cavity 58 has a substantially flat bottom 59 that is parallel to the base 60 of the disk 20. Preferably, the contour of the cavity 58 has a generally parallelepipedic shape, whose short side is substantially equal to the side of the plate 50 and whose long side is greater than the side of the plate 50 by a length at least equal to the length of the elongated holes, and oriented along the length of the elongated holes 34, 35, 36, 37.

The plate 50 is provided to slide in the cavity 58 in the manner of a drawer.

The plate 50 is shown in the form of a generally square sheet, bored with four holes 51, 52, 53, 54, spread to the four corners of a square. The square spreading of the holes is the same as the square spreading of the bushes 38, 39, 40, 41 of the board.

Other shapes for the plate could be used, such as that of a cross, disk, frame, or the like, for a same distribution of the holes.

The plate 50 can be made of metal or plastic, for example, and can have a thickness comprised preferably between 0.1 mm and 1.0 mm, or approximately within the range of 0.1 mm and 1.0 mm.

Figure 2:
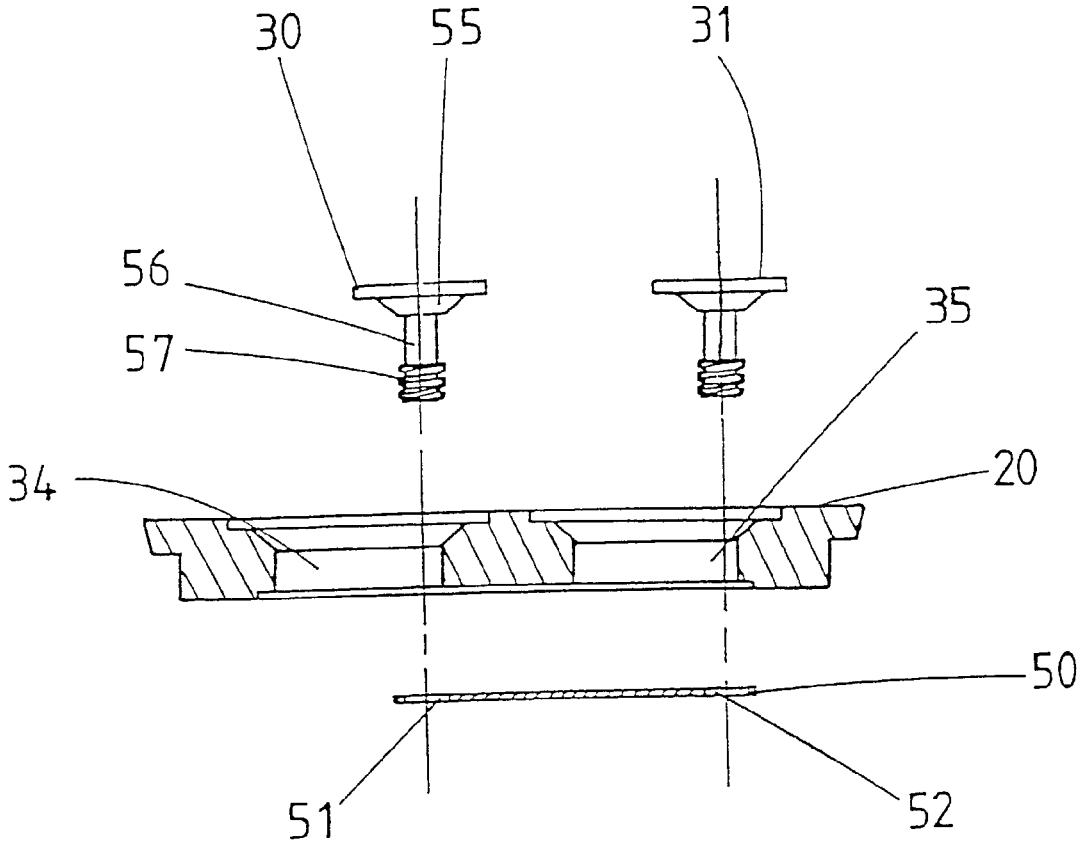
FIG. 2 is an exploded cross-sectional and partial view of the retaining assembly according to FIG. 1.

As can be understood with reference to FIG. 2, the plate 50 and screws 30, 31, 32, 33 are configured so that the plate 50 retains the screws on the disk 20.

For example, the screw 30 has a head 55 extended downwardly by a smooth portion 56, then a threaded portion 57. The diameter of the smooth portion 56 is smaller than the diameter of the hole 51 of the plate 50 through which it passes.

The diameter of the hole 51 is substantially equal to the diameter of the threaded portion 57.

It is thus possible to mount the screw 30 on the plate 50 by forcibly screwing it until the smooth portion 56 reaches the hole 51. After screwing, the threaded portion 57 is located on the other side of the plate 50 with respect to the head 55 and with respect to the disk 20.

The other screws 31, 32, 33 are retained on the plate 50 in the same manner.

Other means could be provided to maintain the screws on the plate 50, such as a radial pin extending through the screw body.

Figure 4:
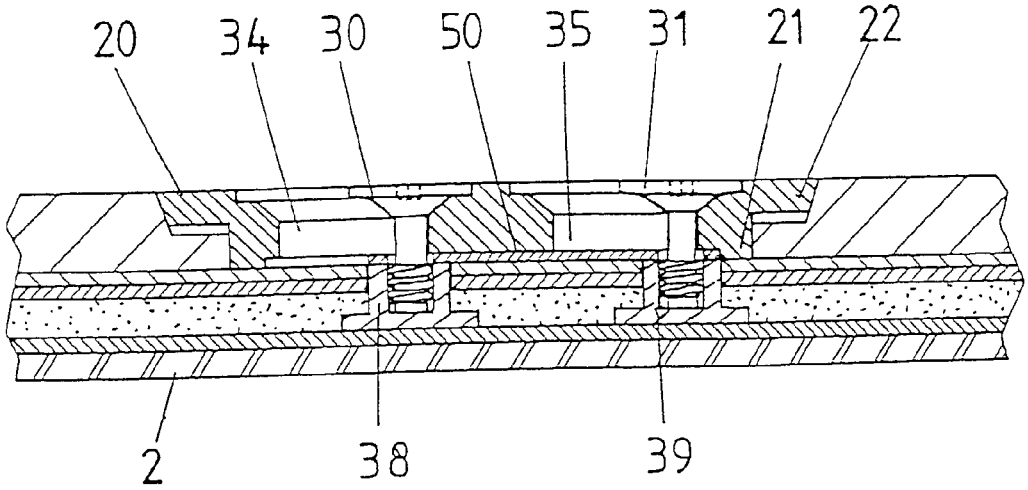
FIG. 4 is a partial cross-section view taken along the line IV-IV of FIG. 1.

As seen in FIG. 4, in the area of the elongated holes 34, 35, the screws 30, 31 extend through both the elongated holes of the disk 20 and the holes 51, 52 of the plate 50, respectively, so as to be screwed into the bushes 38, 39 of the board 2.

Thus, when mounting the retaining assembly 1 on the board 2, the screws are associated with the disk 20, and the positioning of one screw above a bush simultaneously brings about the positioning of the other screws, each above its respective bush. The plate 50 synchronizes the translational displacements of the screws in the elongated holes.

As a result, the mounting of the assembly 1 on the board 2 is advantageously quicker.

If the number of the screws had been different, the number of holes in the plate 50 would also have been different. In the case where three screws are in a delta-arrangement, three holes of the plate are in a delta-arrangement.

Figure 5:
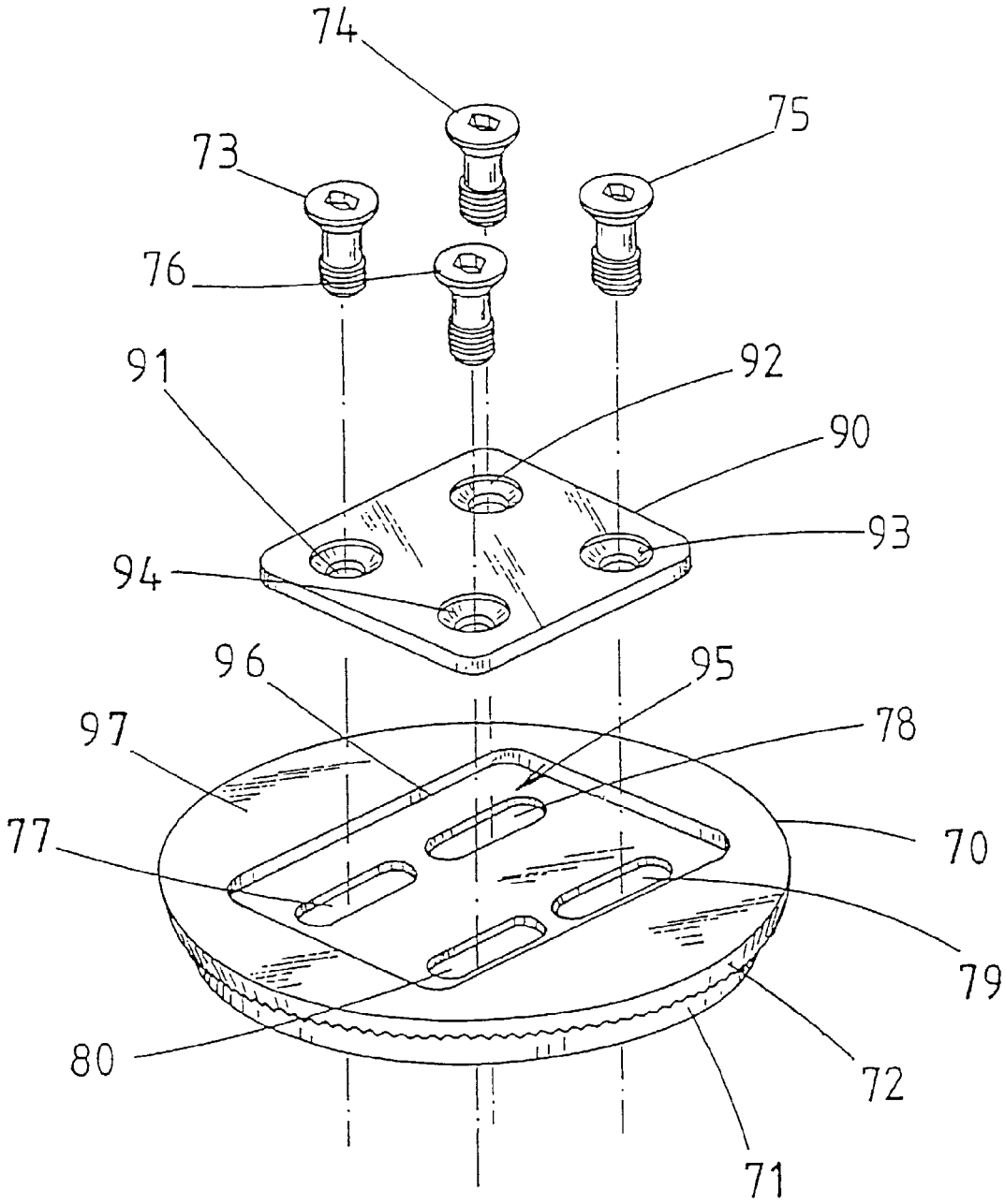
FIG. 5 is a perspective, exploded partial view of a retaining assembly according to a second embodiment of the invention.
Figure 6:
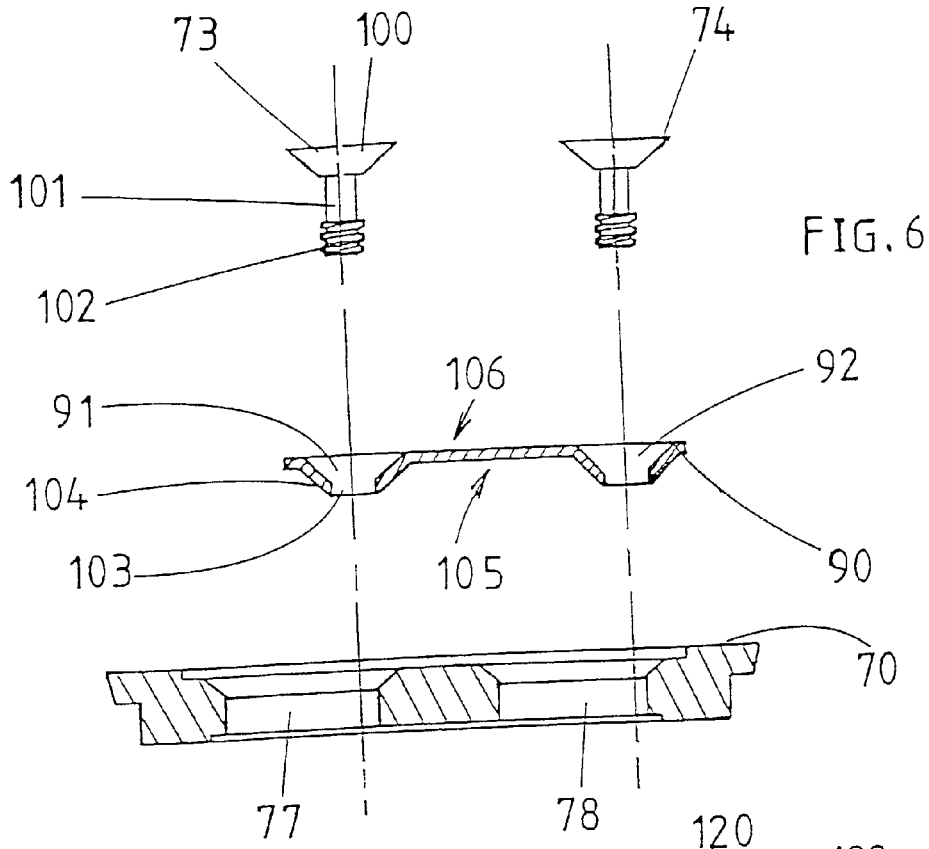
FIG. 6 is an exploded cross-sectional and partial view of the retaining assembly according to FIG. 5.

The second example of embodiment of the invention is presented hereinafter with reference to FIGS. 5 and 6. For reasons of convenience, only the portions that are necessary for understanding are described.

A retaining assembly, not shown, is detachably affixed to a board, not shown, by a disk 70.

In a known manner, the disk 70 preferably has a lower cylinder 71 overlaid by a shoulder 72. The disk is provided to be nested in the base of the retaining assembly. Four screws 73, 74, 75, 76 retain the disk 70 on the board and, to this end, extend through elongated holes 77, 78, 79, 80.

Once again, a different arrangement and/or a different number of elongated holes and screws could be provided.

According to the invention, a plate 90 is arranged so as to be parallel to the disk 70 and above the latter, so that it can slide along the length of the oblong holes 77, 78, 79, 80.

The plate 90 is shown in the form of a generally square sheet, bored with four holes 91, 92, 93, 94 spread to the four corners of a square. Here again, other forms for the plate could be used.

The plate 90 is housed in a cavity 95 provided in the upper portion of the disk 70. The cavity 95 has a substantially flat bottom 96 that is parallel to the upper surface 97 of the disk 70.

Preferably, the contour of the cavity 95 has a generally parallelepipedic shape. The plate 90 can slide in the cavity 95 in the manner of a drawer.

To retain the disk 70 on the board, the screws 73, 74, 75, 76 extend through the holes 91, 92, 93, 94 of the plate 90 and the elongated holes 77, 78, 79, 80 of the disk, respectively.

Here again, the plate 90 synchronizes the displacement of the screws along the elongated holes.

Preferably, retaining means are provided so that each screw remains naturally in a hole of the plate 90. These means are described for the screw 73, for example, by means of FIG. 6.

The screw 73 successively has a head 100, a smooth portion 101, and a threaded portion 102. The diameter of the smooth portion 101 is smaller than the diameter of the lower portion 103 of the hole 91 of the plate 90 in which it passes.

The diameter of the portion 103 of the hole 91 is substantially equal to the diameter of the threaded portion 102.

It is thus possible to mount the screw 73 on the plate 90 by forcibly screwing it into the hole. After screwing, the threaded portion 102 is located on the other side of the plate 90 with respect to the head 100. The other screws 74, 75, 76 are retained on the plate 90 in the same manner.

The plate 90 has four bosses, such as the boss 104 for the screw 73 on the lower surface 105 of the plate. This makes it possible to house the head of each screw in a cavity on the side of the upper surface 106 of the plate.

Here again, other means could be provided to maintain the screws on the plate 90.

Figure 7:
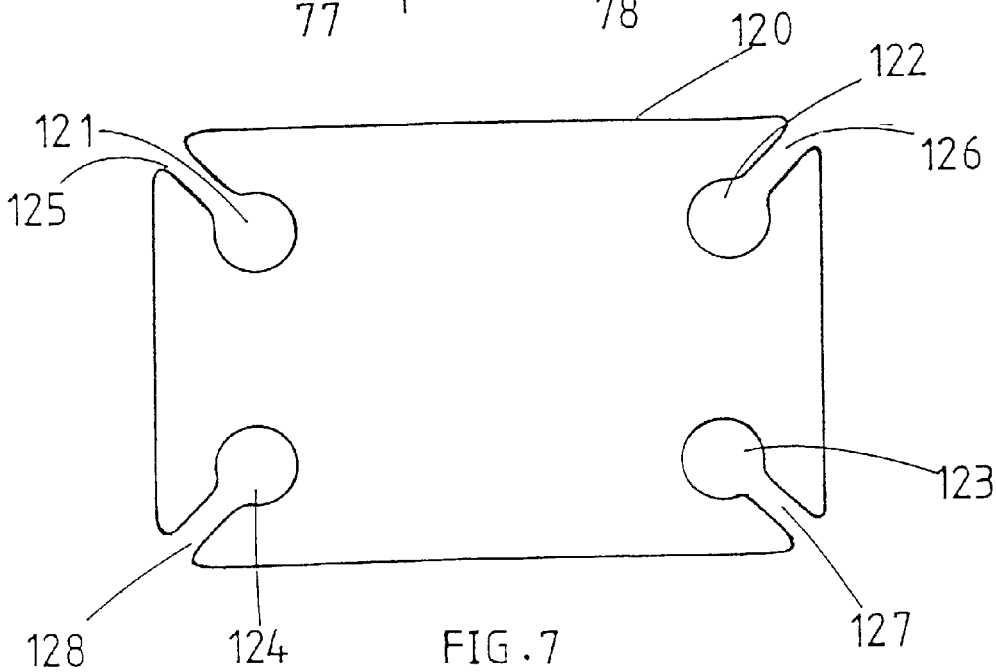
FIG. 7 is a top view of a plate according to a third embodiment of the invention.

The third example of embodiment of the invention is presented hereinafter by means of FIG. 7. For reasons of convenience, only the portions necessary for understanding are described.

This example could be the first or the second, for which the plate has been modified with respect to its structure. The plate, designated by the reference numeral 120, still has holes 121, 122, 123, 124 for the passage of the screws. Each hole communicates with the periphery of the plate via a slit 125, 126, 127, 128. The plate 120 can be made of a plastic or metallic material whose thickness can be comprised between 0.5 mm and 3.0 mm, or approximately therebetween. Each slit enables a deformation of the plate in the area of the hole to which it is connected. It is thus possible to allow a screw to pass by applying an axial force, without rotating it.

Generally speaking, the invention is embodied by all the means and from all the materials known to a person with ordinary skill in the art.

The invention is not limited to the particularly described and illustrated examples heretofore presented, and includes all of the technical equivalents that fall within the scope of the claims that follow.

In particular, the synchronizing plate does not need to be housed in a cavity of the disk.

The synchronizing plate could be made of a plastic material, with deformable bores in the area of the holes for the passage of the screws.

Furthermore, one could provide to arrange elongated holes directly in the base, without using a disk.

What is claimed is:

1. An assembly for retaining a boot on a sports apparatus, said assembly comprising:

a base provided to receive a sole of the boot;

a disk provided to retain the base on the sports apparatus, the disk having four elongated holes, parallel to one another, aligned in pairs, across from one another in pairs, the elongated holes extending through a thickness of disk;

at least two screws each extending through respective ones of the elongated, holes;

a single plate parallel to the disk, the plate being slidable along lengths of the elongated holes, four holes extending through a thickness of the plate, said four holes of the plate being positioned at the four corners of a square;

each of said at least two screws extending through a respective hole of the plate, and plate;

means for retaining the screws on the plate.

2. A retaining assembly according to claim 1, wherein the plate is located on a lower portion of the disk.

3. A retaining assembly according to claim 1, wherein the plate is housed in a cavity of the disk.

4. A retaining assembly according to claim 3, wherein the plate has a generally square shape, and wherein the cavity has a generally parallelepipedic shape.

5. A retaining assembly according to claim 1, wherein said single plate has a predetermined size and shape, wherein said single plate is the only plate of the retaining assembly having said predetermined size and shape.

6. A retaining assembly according to claim 1, wherein the plate is located beneath the disk.

7. A retaining assembly according to claim 6, wherein the plate is housed in a cavity of the disk.

8. An assembly for retaining a boot on a sports apparatus, said assembly comprising:

a base provided to support a sole of the boot, the base being adapted to be affixed to the sports apparatus;

a disk provided to retain the base on the sports apparatus, the disk having at least two elongated holes extending through a thickness of the disk;

at least two screws, said screws provided to extend through respective ones of the elongated holes of the disk;

a plate located beneath the disk and provided to be positioned parallel to the disk and slidable along a surface of the disk, at least two holes extending through a thickness of the plate;

means for retaining the screws on the plate and for connecting the plate to the disk when the base is not affixed to the sports apparatus, all of the at least two screws provided to extend through respective ones of the holes of the plate.

9. An assembly for retaining a boot on a snowboard, said assembly comprising:

a base adapted to be supported on the snowboard and adapted to support a sole of the boot;

a disk provided to retain the assembly on the snowboard, the disk having at least two elongated holes extending through a thickness of the disk, each of the two elongated holes being elongated in the same direction;

a single plate positioned for sliding in the direction of the elongated holes, the plate having at least two holes extending through a thickness of the plate, the plate being located beneath the disk;

at least two screws, each of the two screws having a threaded portion and a head;

the two screws extending through respective ones of the two elongated holes of the disk, all of the at least two screws extending through respective ones of the holes of the plate and, for each of the screws, the head and the threaded portion, after the screw has been screwed through the plate, are positioned on opposite sides of the plate.

10. A retaining assembly according to claim 9, wherein the plate is housed in a cavity of the disk.

11. A retaining assembly according to claim 10, wherein the plate has a generally square shape, and wherein the cavity of the disk has a generally parallelepipedic shape.

12. A retaining assembly according to claim 9, wherein all of the at least two screws are sized, relative to respective ones of the holes of the plate, to be forcibly screwed through said respective ones of the holes of the plate.

13. A retaining assembly according to claim 9, wherein the plate is made of plastic and has a thickness approximately within a range of between 0.5 mm and 3.0 mm.

14. A retaining assembly according to claim 9, wherein the plate is made of metal and has a thickness approximately within a range of between 0.5 mm and 3.0 mm.

15. A retaining assembly according to claim 9, wherein said single plate has a predetermined size and shape, wherein said single plate is the only plate of the retaining assembly having said predetermined size and shape.

16. An assembly for retaining a boot on a snowboard, said assembly comprising:

a base adapted to be supported on the snowboard and adapted to support a sole of the boot;

a disk provided to retain the assembly on the snowboard, the disk having at least four elongated holes elongated in the same direction, said holes extending through a thickness of the disk, the four elongated holes being arranged in two spaced-apart pairs of elongated holes;

a single plate positioned for sliding in the direction of the elongated holes, the plate having at least four holes extending through a thickness of the plate, the four holes being positioned at four corners of a square at least two screws, each of the screws having a threaded portion and a head;

the at least two screws extending through respective ones of the elongated holes of the disk, all of the at least two screws extending through respective ones of the holes of the plate and, for each of the screws, the head and the threaded portion, after the screw has been screwed through the plate, are positioned on opposite sides of the plate.

17. An assembly for retaining a boot on a snowboard, said assembly comprising:

a base adapted to be secured onto the snowboard and adapted to support a sole of the boot, the base comprising:

a circular opening through a thickness of the base;

a circular disk nested in the circular opening for rotation within the circular opening;

at least two elongated holes extending through the disk, each of the two elongated holes being elongated in the same direction;

a single plate positioned for sliding in the direction of the elongated holes, the plate having at least two holes extending through a thickness of the plate, the plate being positioned beneath the disk;

at least two screws, each of the two screws having a threaded portion and a head;

the two screws extending through respective ones of the two elongated holes of the base, all of the at least two screws extending through respective ones of the holes of the plate and, for each of said screws, the head and the threaded portion, after the screw has been screwed through the plate, are positioned on opposite sides of the plate.

18. A retaining assembly according to claim 17, wherein the plate is positioned above the disk.

19. A retaining assembly according to claim 17, wherein the plate is housed in a cavity of the disk.

20. A retaining assembly according to claim 19, wherein the plate has a generally square shape, and wherein the cavity of the disk has a generally parallelepipedic shape.

21. A retaining assembly according to claim 17, wherein all of the at least two screws are sized, relative to respective ones of the holes of the plate, to be forcibly screwed through said respective ones of the holes of the plate.

22. A retaining assembly according to claim 17, wherein the plate is made of plastic and has a thickness approximately within a range of between 0.5 mm and 3.0 mm.

23. A retaining assembly according to claim 17, wherein the plate is made of metal and has a thickness approximately within a range of between 0.5 mm and 3.0 mm.

24. A retaining assembly according to claim 17, wherein said single plate has a predetermined size and shape, wherein said single plate is the only plate of the retaining assembly having said predetermined size and shape.

25. An assembly for retaining a boot on a snowboard, said assembly comprising:

a base adapted to be secured onto the snowboard and adapted to support a sole of the boot, the base comprising:

a circular opening through a thickness of the base; and a circular disk nested in the circular opening for rotation within the circular opening;

four elongated holes elongated in the same direction, said holes extending through the disk, the four elongated holes being arranged in two spaced-apart pairs of elongated holes;

a single plate positioned for sliding in the direction of the elongated holes of the disk, the plate having four holes positioned at four corners of a square;

at least two screws, each of the screws having a threaded portion and a head;

the at least two screws extending through respective ones of the elongated holes of the base, all of the at least two screws extending through respective ones of the holes of the plate and, for each of said screws, the head and the threaded portion, after the screw has been screwed through the plate, are positioned on opposite sides of the plate.

26. An assembly for retaining a boot on a sports apparatus, said assembly comprising:

a base provided to receive a sole of the boot;

a disk provided to retain the base on the sports apparatus, the disk having at least three elongated holes, the elongated holes extending through a thickness of the disk;

at least two screws each extending through respective ones of the elongated holes;

a single plate parallel to the disk, the plate being slidable along lengths of the elongated holes, at least three holes extending through a thickness of the plate, the three holes of the plate being arranged at vertices of a triangle;

each of said at least two screws extending through a respective hole of the plate;

means for retaining the screws on the plate.

27. A retaining assembly according to claim 26, wherein the disk has at least four elongated holes and the plate has at least four holes, the four holes of the plate being arranged at corners of a rectangle.

28. An assembly for retaining a boot on a snowboard, said assembly comprising:

a base adapted to be supported on the snowboard and adapted to support a sole of the boot;

a disk provided to retain the assembly on the snowboard, the disk has having at least three elongated holes extending through a thickness of the disk, each of the two elongated holes being elongated in the same direction;

a single plate positioned for sliding in the direction of the elongated holes, the plate having at least three holes, the three holes of the plate being arranged at vertices of a triangle and extending through a thickness of the plate;

at least two screws, each of the two screws having a threaded portion and a head;

the two screws extending through respective ones of the elongated holes of the disk, all of the at least two screws extending through respective ones of the holes of the plate and, for each of the screws, the head and the threaded portion, after the screw has been screwed through the plate, are positioned on opposite sides of the plate.

29. A retaining assembly according to claim 28, wherein the disk has at least four elongated holes and the plate has at least four holes, the four holes of the plate being arranged at corners of a rectangle.

30. An assembly for retaining a boot on a snowboard said assembly comprising:

a base adapted to be secured onto the snowboard and adapted to support a sole of the boot, the base comprising:

a circular opening through a thickness of the base;

a circular disk nested in the circular opening for rotation within the circular opening;

at least three elongated holes extending through the disk, each of the two elongated holes being elongated in the same direction;

a single plate positioned for sliding in the direction of the elongated holes, the plate having at least three holes extending through a thickness of the plate the three holes of the plate, the three holes of the plate being arranged at vertices of a triangle;

at least two screws, each of the two screws having a threaded portion and a head;

the two screws extending through respective ones of the elongated holes of the base, all of the at least two screws extending through respective ones of the holes of the plate and, for each of said screws, the head and the threaded portion, after the screw has been screwed through the plate, are positioned on opposite sides of the plate.

31. A retaining assembly according to claim 30, wherein the base has at least four elongated holes and the plate has at least four holes, the four holes of the plate being arranged at corners of a rectangle.

32. An assembly for retaining a boot on a sports apparatus, said assembly comprising:

a base provided to receive a sole of the boot;

a disk provided to retain the base on the sports apparatus, the disk has comprising:

at least two elongated holes, parallel to one another, the elongated holes extending through a thickness of the disk;

an upper surface adapted to face upwardly relative to the sports apparatus, when the assembly is retained on the sports apparatus;

a lower surface adapted to face downwardly relative to the sports apparatus, when the assembly is retained on the sports apparatus;

a cavity recessed in the lower surface of the disk;

at least two screws each extending through respective ones of the elongated holes;

a single plate parallel to the disk, the plate being slidable along lengths of the elongated holes, at least two holes extending through a thickness of the plate the plate being housed in the cavity of the disk and being slidably movable within the cavity at least in a direction along the lengths of the elongated holes of the disk;

each of said at least two screws extending through a respective hole of the plate;

means for retaining the screws on the plate.

33. An assembly for retaining a boot on a snowboard, said assembly comprising:

a base adapted to be secured onto the snowboard and adapted to support a sole of the boot, the base comprising:

a circular opening through a thickness of the base;

a circular disk nested in the circular opening for rotation within the circular opening, the disk comprising:

at least two elongated holes extending through the disk, each of the two elongated holes being elongated in the same direction;

an upper surface adapted to face upwardly relative to the sports apparatus, when the assembly is retained on the sports apparatus;

a lower surface adapted to face downwardly relative to the sports apparatus, when the assembly is retained on the sports apparatus;

a cavity recessed in the lower surface of the disk;

a single plate positioned for sliding in the direction of the elongated holes, the plate having at least two holes extending through a thickness of the plate the plate being housed in the cavity of the disk and being slidably movable within the cavity at least in a direction along the lengths of the elongated holes of the disk;

at least two screws, each of the two screws having a threaded portion and a head;

the two screws extending through respective ones of the two elongated holes of the base, all of the at least two screws extending through respective ones of the holes of the plate and, for each of said screws, the head and the threaded portion, after the screw has been screwed through the plate, are positioned on opposite sides of the plate.

34. An assembly adapted to retain a boot on a sports apparatus, said assembly comprising:

a base adapted to be supported on the sports apparatus and adapted to support a sole of the boot, said base comprising:

a through opening; and a disk supportable above said through opening, at least two elongated holes extending through a thickness of said disk, each of said two elongated holes being elongated in the same direction;

a plate having a predeterminate size and shape, said plate being the one and only plate of said assembly having said predeterminate size and shape, the plate being located beneath the disk;

said plate being slidably positionable relative to said base in the direction of said elongated holes, said plate having at least two holes extending through a thickness of said plate;

a plurality of screws, each of said screws having a single predeterminate size and shape to extend through a respective one of said elongated holes of said base, through a respective one of said holes of said plate, and into an upper surface of the sports apparatus to secure said base onto the sports apparatus;

said plurality of screws comprising means for retaining said plate connected to said base when said plurality of screws are not screwed into the sports apparatus.

35. An assembly adapted to retain a boot on a sports apparatus, said assembly comprising:

a base adapted to be supported on the sports apparatus and adapted to support a sole of the boot, said base comprising:

a through opening; and a disk supportable above said through opening, at least two elongated holes extending through a thickness of said disk, each of said two elongated holes being elongated in the same direction;

a plate having a predeterminate size and shape, said plate being the one and only plate of the assembly having said predeterminate size and shape, the plate being located beneath the disk;

said plate being slidably positionable relative to said base in the direction of said elongated holes, said plate having at least two holes extending through a thickness of said plate;

a plurality of screws, each of said screws having a single predeterminate size and shape to extend through a respective one of said elongated holes of said base, through a respective one of said holes of said plate, and into an upper surface of the sports apparatus to secure said base onto the sports apparatus;

said base being positionable between a disassembled position, whereby the retaining assembly is not secured onto the sports apparatus, and an assembled position, whereby the retaining assembly is secured onto the sports apparatus;

in said assembled position of the retaining assembly, every screw extending into the upper surface of the sports apparatus extends through said plate of the assembly.

36. A retaining assembly according to claim 35, wherein said plurality of screws comprise means for retaining said plate connected to said base when said plurality of screws are not screwed into the sports apparatus.

* * * * *